US005845704A

United States Patent [19]

Lavelle et al.

[11] Patent Number: 5,845,704

[45] Date of Patent: Dec. 8, 1998

[54] HEAT EXCHANGER BAFFLE DESIGN

[75] Inventors: Kenneth Edward Lavelle, Temecula; Ronald Leslie Grace, Fallbrook, both of Calif.

[73] Assignee: Flowserve Management Company, Irving, Tex.

[21] Appl. No.: 857,797

[22] Filed: May 16, 1997

[51] Int. Cl.[6] ..... F28D 7/10

[52] U.S. Cl. ..... 165/163; 165/76

[58] Field of Search ..... 165/134.1, 163, 165/76

[56] References Cited

U.S. PATENT DOCUMENTS

| | | | |
|---|---|---|---|
| 2,160,898 | 6/1939 | Peff | 165/163 X |
| 2,508,247 | 5/1950 | Giaque | 165/163 |
| 2,668,692 | 2/1954 | Hammell | 165/163 |
| 2,888,251 | 5/1959 | Dalin | 165/163 X |
| 3,100,523 | 8/1963 | Marrujo | 165/163 X |
| 3,286,767 | 11/1966 | Evans . | |
| 3,526,273 | 9/1970 | Wentworth, Jr. . | |
| 3,802,499 | 4/1974 | Garvea . | |
| 4,190,104 | 2/1980 | Frei . | |
| 4,313,491 | 2/1982 | Molitor . | |
| 4,669,533 | 6/1987 | Hehl . | |
| 5,309,987 | 5/1994 | Carlson . | |

FOREIGN PATENT DOCUMENTS

| | | |
|---|---|---|
| 3146460 | 7/1983 | Germany . |
| 1746185 | 7/1992 | U.S.S.R. . |

*Primary Examiner*—Allen J. Flanigan
*Attorney, Agent, or Firm*—Pretty, Schroeder & Poplawski

[57] ABSTRACT

An improved heat exchanger in which a housing defines an annular space containing coolant and a tube for carrying working fluid through the coolant. On the top end of the casing there is a cover that seals the annular space and provides entry and exit portals for the tube and the coolant. Maintenance and/or cleaning of the heat exchanger is accomplished by removing the cover and pulling the tube from the annular space. Baffles formed from flexible sheets of material isolate the surface of the coil from the housing thereby reducing corrosive bonding and easing the removal process. Tapered edges along the annular space also help overcome any binding that might occur between the housing and the coil or the baffles.

12 Claims, 3 Drawing Sheets

HEAT EXCHANGER BAFFLE DESIGN

This invention relates to heat exchangers of the helical coil type and, in particular, to an improvement which facilitates disassembly and cleaning by reducing the binding effect of contaminates and corrosive bonding between the helical coil and its casing.

BACKGROUND OF THE INVENTION

Heat exchangers have long been used to raise or lower the temperature of a working fluid. Several basic designs will accomplish this end, but invariably each relies on the basic principle of thermodynamics that thermal energy will tend to migrate from a warm body to a cooler one. One common type of heat exchanger circulates the working fluid through a tube which is immersed in a bath of coolant contained within a housing. Thus the thermal energy will pass from the hotter of the two fluids, through the walls of the tube, to the cooler fluid. The rate of energy transfer is the greatest where the temperature gradient is large, and decreases as the temperature of both fluids approaches equilibrium.

Since the thermal energy transfer between the fluids increases as the surface area of the tube increases, the tube is ideally wound into a coil or otherwise condensed to maximize the surface area exposed to the fluids while minimizing the size of the case. Moreover, in order to maintain continuous operation, fresh coolant is preferably circulated through the case.

One particularly efficient design that incorporates both of these features is described in U.S. Pat. No. 3,526,273, to Wentworth (the "Wentworth patent"), which is incorporated herein by reference. This patent teaches a heat exchanger in which the case defines a cylindrical annular space, and the tube is wrapped into a helical coil which fits inside the annular space.

The bottom end of the annular space is closed by an endwall, and on the lop end there is a removable cover. Both the inlet and outlet ends of the tube extend through the cover, and the coil is wrapped into multiple overlapping layers that spiral alternatingly between the endwall and the cover. Coolant is introduced into the casing through a second set of ports in the cover, and circulates around the outside of the tube in a spiral path corresponding to the turns of the helical coil.

The Wentworth device is particularly effective because by forcing the coolant to travel along the path of the spiraling tube the exposure between the fluids is maximized. Another advantage of the Wentworth device is that since the cover is removable, the helical coil may be pulled from the annular space for maintenance and/or cleaning. Unfortunately, since there is no separate tube for the coolant, the coolant (usually water) is in direct contact with the coil as well as the casing walls. Thus any impurities from the coolant, as well as any corrosion of the casing walls and tubes caused by the coolant, will eventually build-up restricting coolant flow and decreasing the interval periods between cleanings. To the extent that this build-up creates a bond between the coil and the casing, it will become increasingly difficult to remove the coil from the case to accomplish the cleanings. Moreover, build-ups are an increasing problem due to increasing environmental restrictions on chemical treatments of cooling water to remove impurities.

In view of the above, it should be appreciated that there is still a need for a compact heat exchanger which provides the advantages of free-flowing coolant yet can still be dismantled and reassembled for cleaning or maintenance with little or no obstruction from dirt build-up or corrosive bonding.

SUMMARY OF THE INVENTION

The present invention is embodied in a heat exchanger having a helical coil arranged in a casing whereby coolant can freely circulate around the coil without creating significant dirt build-up or corrosive bonding between the coil and the casing walls. This heat exchanger, in combination with the other features described below, permits the coil to be easily removed from the casing for periodic cleaning or maintenance without damage to the coil. Moreover, this heat exchanger accomplishes these ends through a design that is both simple and inexpensive to manufacture.

The heat exchanger includes a case having an inner wall spaced within an outer wall to form an annular space therebetween. The annular space is enclosed by an end wall at the bottom end and a removable cover at the top end. Inside the case there is a tube which has been wound into a helical coil that fits snugly into the annular space. Inlet and outlet connections for the tube extend outside the case to permit circulation of a working fluid through the interior of tube. Additional connections are provided in the case to allow coolant to be circulated between the coils of the tube prompting the transfer of thermal energy between the working fluid and the coolant.

An important feature of the present invention is that it includes an outer baffle made from a sheet of flexible material that is wrapped around the outer surface of the coil. Thus the coil, and the coolant flowing between the wraps of the coil, will be isolated from the outer wall of the casing. This is advantageous because any dirt or corrosive build-up that might otherwise tend to bind the coil within the casing, will now be restricted to the interior of the outer baffle. Moreover, since wall temperatures around the casing are reduced, the corrosion rate is lessened. This allows a further advantage in selecting lower alloy materials. The interface between the baffle and the outer wall of the casing will remain smooth and unobstructed so that when the cover is removed, the coil along with the outer baffle can easily be pulled from the annular space.

Another feature of this invention is that an inner baffle can also be placed adjacent the inner diameter of the coil to isolate the coil from the inner wall of the case as well. This further enhances the removability of the coil from the case in the same manner as the outer baffle.

Another feature of the present invention is that the baffles can be provided with a slit along their axial length. This slit may be between abutting edges of the baffle if it is fit to the exact surface area of the coil, or it may be the edge of an overlap when the baffle is cut larger than the surface area of the coil. This is advantageous because the slit provides a means by which the edge of the baffle may easily be grasped. Thus, once the coil has been removed from the annular space, the baffle can be peeled from the surface of the coil to permit cleaning.

In another embodiment of this invention, the radial dimension of the annular space may be slightly smaller at the bottom (i.e. near the end wall) than at the top (i.e. near the cover). This tapered configuration is particularly advantageous because it facilitates removal of the coil from the annular space. Even if the coil has swollen under the pressure or heat of the working fluid, or if there is some build-up of dirt or corrosion binding the coil to the case, the obstructions will only affect the initial stages of the coil removal. After the coil has been broken free, the width of the annular space will become progressively larger than the obstructions. Thus the coil should slide freely along the rest of the annular space.

Other features and advantages of the present invention will become apparent from the following description of the preferred embodiment, taken in conjunction with the accompanying drawings, which illustrate, by way of example, the principles of the invention.

DETAILED DESCRIPTION OF THE PREFERRED EMBODIMENT

Figure 1:
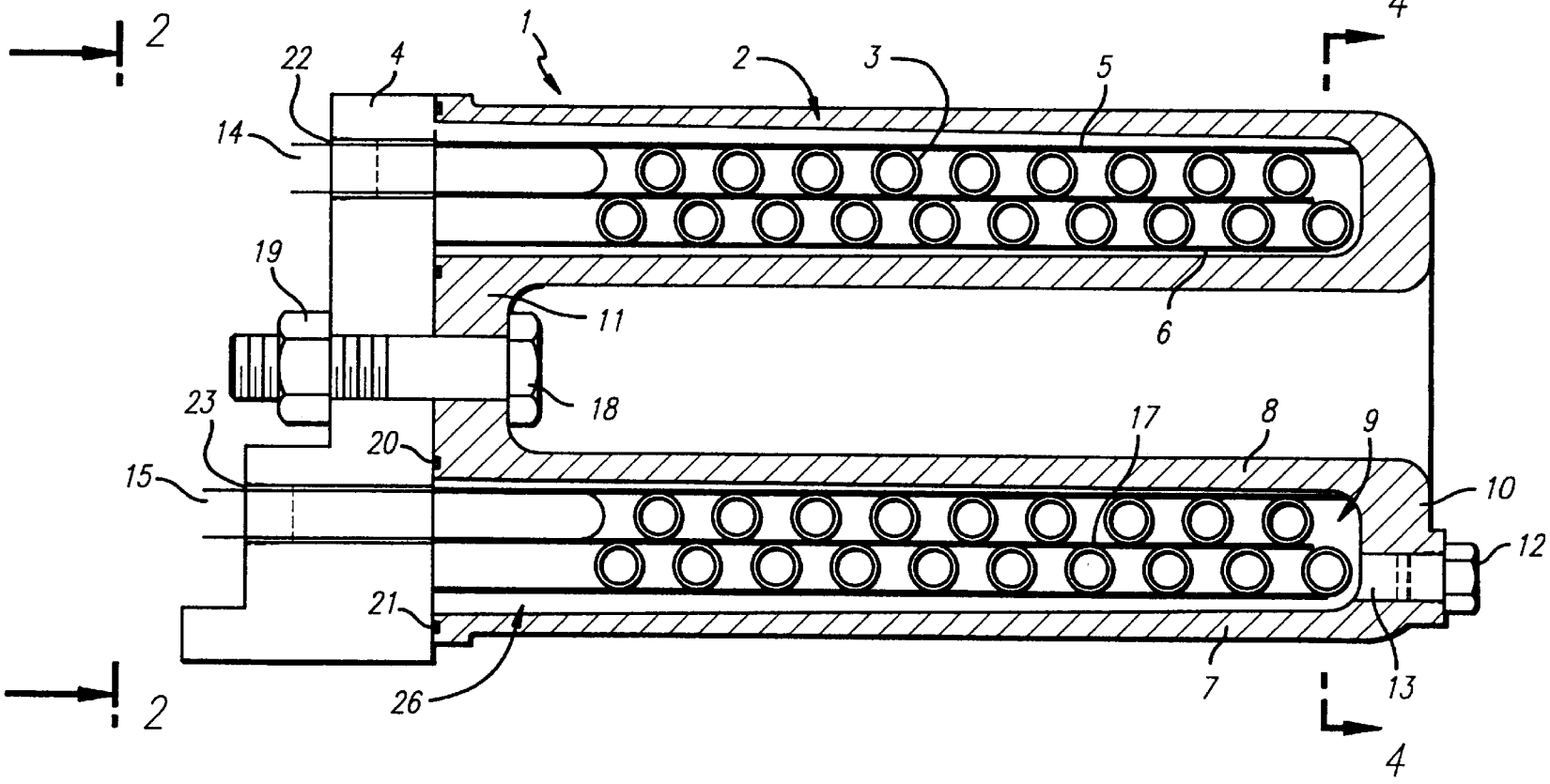
FIG. 1 is a longitudinal sectional view illustrating a heat exchanger embodying the features of the present invention.

As shown in the accompanying drawings, the present invention is embodied in a heat exchanger, generally indicated by the reference numeral 1, for use in transferring thermal energy between a working fluid and a coolant. The heat exchanger includes a case 2, a working tube 3, a cover 4 and baffles 5 and 6 which separate the coil from the walls of the case.

The single piece case 2 includes a cylindrical outer wall 7 which is spaced radially outward from a cylindrical inner wall 8 forming an annular space 9 therebetween. A first end of the case, hereinafter referred to as the bottom end, has an endwall 10 extending between the inner and outer walls closing the bottom end of the annular space. At the other end of the case, hereinafter referred to as the top end, the annular space is open. The interior of the cylindrical inner wall is open at the bottom end, but the top end is closed by a web 11. Drain plug 12 is threaded into drain hole 13.

Figure 4:
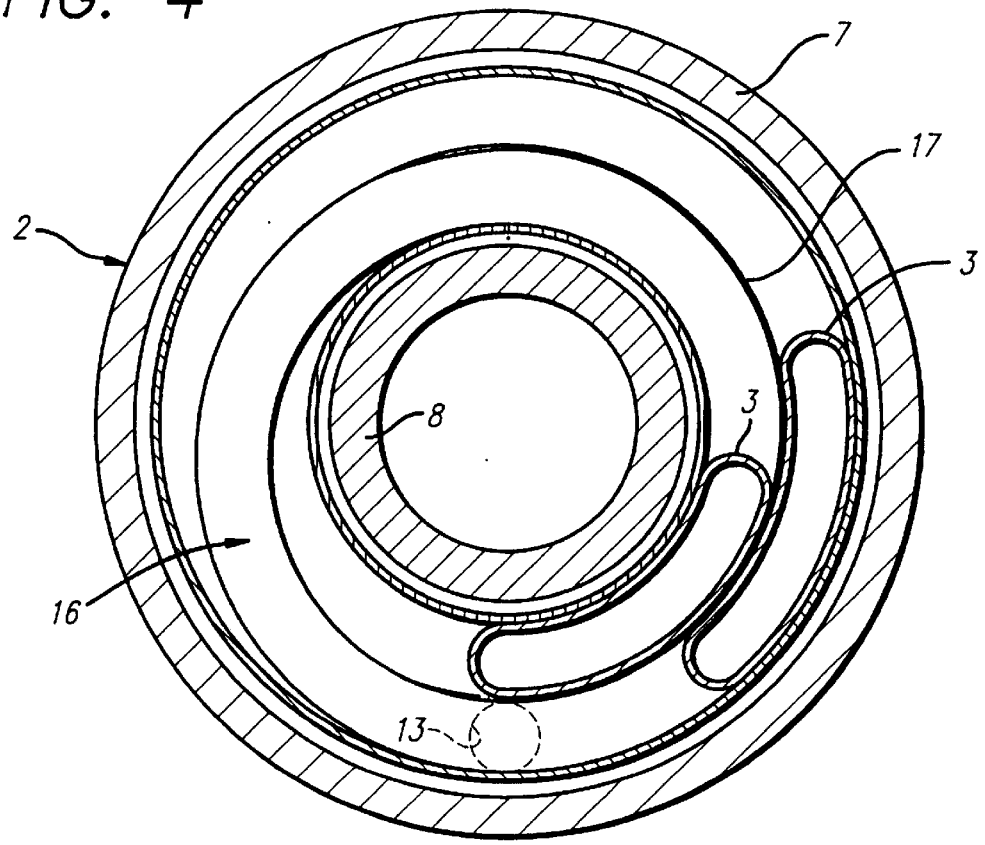
FIG. 4 is a cross-sectional view, taken near the bottom of the casing along line 4—4 of FIG. 1.
Figure 3:
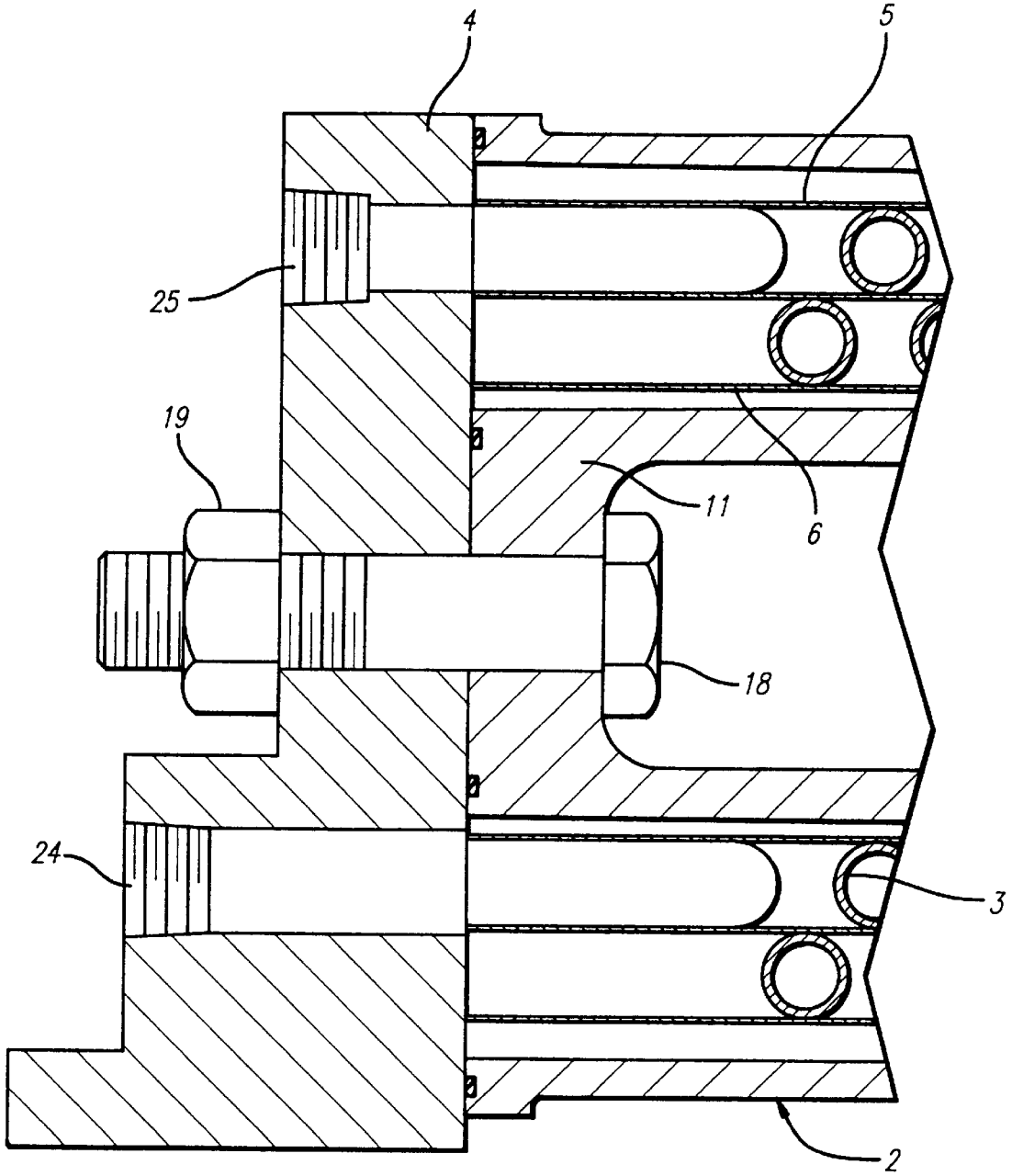
FIG. 3 is a partial cross-sectional view taken along line 3—3 of FIG. 2.

The working tube 3, which is positioned within the annular space 9, comprises a single length of corrosion resistant tubing, preferably made of copper or stainless steel. The tube is wrapped into a multiple layered helical coil which spirals alternatingly between the top and bottom ends of the casing. Ends 14 and 15 of the tube bend away from the turns of the coil and extend toward the top of the case. Referring briefly to FIG. 4, the inner layer of the coil is joined to the adjacent outer layer in a transitional area 16 at the end of the case. Between the layers there is a spacer 17 made of a sheet of material that preferably is resistant to corrosion.

In practice, the tube is most easily formed into the coil on a mandrel (not illustrated) before it is placed in the annular space 9. The winding of the coil starts with the inner layer which is wound in a spiral fashion around the mandrel until the desired length of the coil is reached. A spacer 17 is then wrapped around the entire surface of the inner layer except for a relatively small portion which is cut away in the transitional area. The tube is then bent slightly outward through the transitional area and wound on top of the spacer in the axial direction opposite the inner layer. While the preferred embodiment illustrates only two layers, one skilled in the art would understand that more layers could be used depending on the size of the annular space and the length and diameter of the tubing to be placed therein. These alternating layers are formed in a continuous fashion with spacers therebetween until the desired number of layers has been obtained. Preferably, however, there will be an even number of layers so that the inlet and outlet ends of the tube will both extend toward the top end of the case.

A cover 4 is attached to the top end of the case 2 closing the top of the annular space 9. The cover is held onto the case by a bolt 18 which extends through the cover and through the web 11, and is fixed thereto by nut 19. O-rings 20 and 21 which are located in seats on the top ends of the inner wall 8 and outer wall 7, respectively, ensure that the cover is properly sealed to the case.

An outer baffle 5 surrounds the outer diameter of the coil, and adjacent the inner surface of the coil 3 is an inner baffle 6. In practice the baffles are attached to the coil prior to its insertion into the case 2 and thus must be thin enough so as not to prevent the coil from fitting in the annular space. After the coil has been inserted into the case, the baffles will isolate the inner and outer surfaces of the coil from the inner and outer walls of the case respectively.

The inner and outer baffles are formed from a flat, flexible sheet of material which is wrapped adjacent the respective surfaces of the coil. Typical baffle material is a corrosion resistant stainless steel alloy. Each baffle is preferably sized to fit exactly to the surface of the coil. Thus, when the baffle is wrapped adjacent the coil, the opposing edges of the baffle will abut exactly without overlapping. This juncture, or slit, provides an edge by which the baffle can subsequently be grasped for removal. Alternatively, if the baffles are sized larger than the surface area of the coil, there will be a slight overlap in the axial direction along both baffles and the slit along the overlap will be used to grasp the edge of the baffles. Note that an adhesive (not illustrated) may also be used to at least temporarily adhere the baffles to the coil before it is inserted into the case. However, the adhesive must not be so strong as to cause damage to the coil when the baffle is subsequently removed for cleaning.

Figure 2:
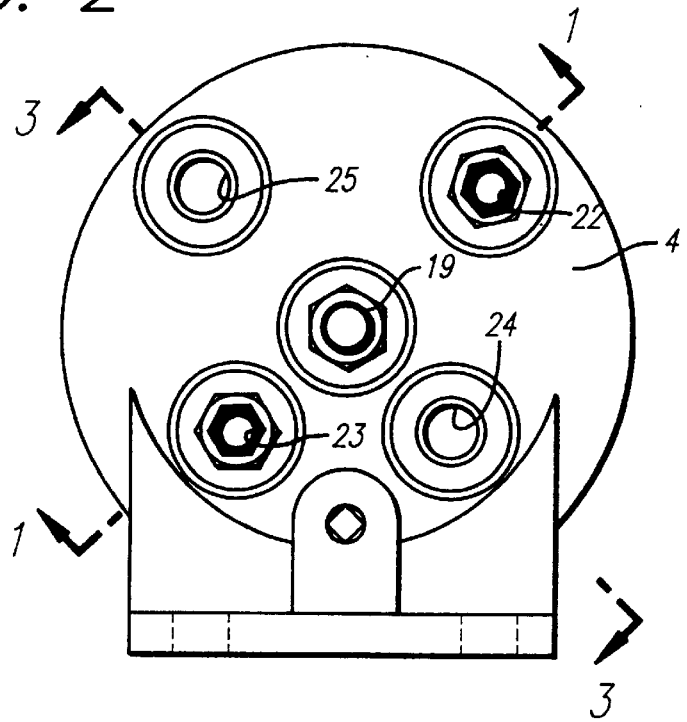
FIG. 2 is an end view of the cover of the heat exchanger, taken along line 2—2 of FIG. 1.

As illustrated in FIG. 2, the cover includes four ports. Ports 22 and 23 accept and retain the inlet and outlet ends of tube 14 and 15, and ports 24 and 25 allow the circulation of coolant through the case. With this arrangement, coolant enters the annular space 9 through inlet port 24 and is carried in a helical path between each convolution of the inner layer of the helical coil 3. In transition area 16, the coolant follows along the transition of the coil 3 through the cutaway section of the spacer 17 to the adjacent outer layer of the coil. The coolant then spirals between the convolutions of the coil back toward the top of the case and exits the case through port 25. Conversely, the working fluid travels in the opposite direction. It enters the case through inlet 22, travels through the outer layer of the coil, transitions to the inner layer, and exits through port 23.

The coolant, typically water, will almost invariably contain at least trace amounts of impurities. Further, though all of the components are preferably formed from materials resistant to corrosion, at least some chemical breakdown of the components will likely occur over an extended period of use. These contaminants will eventually build-up along the coolant's path of travel restricting the flow of coolant as well as insulating the transfer of thermal energy between the fluids. Thus, to minimize these effects, the heat exchanger requires periodic maintenance and cleaning. This requires access to the interior components best attainable by removing the coil from the case.

Prior to disassembling the case, the coolant is preferably removed through drain hole 13. Nut 19 is then removed from bolt 18 freeing cover 4 from the case 2. This allows removal of the coil 3 from the annular space 9 as the ends of the coil are secured to the cover. Note that regardless of whether the coolant has created a dirt or corrosive build-up between the coils and baffles, the interface between the baffles and the case will remain relatively smooth so as not to hinder removal of the coil.

After the coil 3 has been removed from the case 2, the inner and outer baffles 5 and 6 may be removed from the coil to allow access for cleaning. Slits along the axial direction of each baffle allow the edges to be grasped and removed by peeling them from the surfaces of the coil. After the case and the coils have been cleaned, new baffles can be attached, and the coil and baffles can be replaced in the case until the next required cleaning or maintenance.

In an improved embodiment, the width of the annular space (i.e. the distance between the inner and outer walls) gradually increases from the bottom of the case to the top. Thus, even if there is some dirt or corrosive build-up between the case and the coils or baffles, the tapered annular space will help overcome any binding it might cause. Once the bolt 18 has been loosened, a wedge can be driven between the cover and the case to break the coil free. Then the coil can be freely pulled from the case since the annular space from there on will be larger than the build-up.

For the purposes of illustration, the case 2 shown in FIG. 1 shows an exaggerated taper. However, it is to be understood that the degree of taper must be balanced between the desire to improve removability and the necessity that the coil and baffles fit snugly within the annular space. If the taper is too drastic there will be too much space between the coil and the walls of the case near the top (indicated generally by 26). Thus the coolant will either stagnate between the baffle and the case, or the pressure of the coolant will cause the baffle to separate from the coil. The ideal range of taper is from 0.062 inches to 0.250 inches per foot of axial length.

Although the invention has been described in detail with reference only to the preferred embodiment, those having ordinary skill in the art will appreciate that various modifications can be made without departing from the spirit of the invention. For example, it should be understood that this device could also be used to raise the temperature of the working fluid simply by replacing the coolant with a fluid that is warmer than the working fluid. With such possibilities in mind, the invention is defined with reference to the following claims.

We claim:

1. A heat exchanger comprising:

a case having an inner wall spaced within an outer wall forming an annular space therebetween, and an endwall fixed to one end of the case enclosing a bottom end of the annular space;

a cover detachably fixed to the end of the case distant from the endwall thereby enclosing a top end of the annular space;

a tube located within the annular space, wherein the tube is formed into a helical coil encircling the inner wall and extending between the cover and the endwall, and wherein the tube includes fluid inlet and outlet connections that extend outside the case and permit circulation of working fluid through the tube;

a coolant inlet for introducing coolant to the interior of the case and a coolant outlet for removing coolant from the case; and, an outer baffle formed from a flexible sheet of material and wrapped adjacent the outer diameter of the helical coil thereby separating the coil from the outer wall such that, when the cover is detached from the case, the coil and the outer baffle can be removed from the annular space with limited impediment by dirt build-up or corrosive bonding between the coil and the outer wall;

wherein the tube is arranged within the annular space such that substantially all of the coolant flows in a helical pattern between adjacent coils of the tube.

2. The heat exchanger of claim 1, further comprising an inner baffle formed from a flexible sheet of material and placed adjacent the inner diameter of the coil thereby separating, and restricting dirt build-up and corrosive bonding between the coil and the inner wall.

3. The heat exchanger of claim 2 wherein the inner and outer baffles are made of a material that resists corrosion in the coolant.

4. The heat exchanger of claim 1 wherein the outer baffle includes an axial slit along its full length whereby the outer baffle can be grasped and removed from the outer surface of the coil after the coil has been removed from the case.

5. The heat exchanger of claim 2 wherein the inner baffle includes an axial slit along its full length whereby the inner baffle can be folded inward, grasped and removed from the inner surface of the coil after the coil has been removed from the case.

6. A heat exchanger comprising:

a case having a cylindrical inner wall spaced within a cylindrical outer wall forming an annular space therebetween, and an endwall fixed to one end of the case enclosing a first end of the annular space;

a cover detachably fixed to the housing on the end distant from the end wall thereby enclosing a second end of the annular space;

a tube located within the annular space, wherein the tube is formed into a helical coil encircling the inner wall, and wherein the tube includes fluid inlet and outlet connections that extend outside the case and permit circulation of working fluid through the tube;

a means for circulating coolant between adjacent coils of the tube in a spiral path generally corresponding to the space between the convolutions of the helical coil, wherein the circulating means includes a coolant inlet for introducing coolant to the interior of the case and a coolant outlet for removing coolant from the case; and, wherein the radial width of the annular space is smaller at the first end than at the second end and steadily increases from the first end to the second end such that when the cover is detached from the case, the coil can be removed from the case with limited impediment by dirt build-up or corrosive bonding between the tube and the exterior wall.

7. The heat exchanger of claim 6 further comprising inner and outer baffles formed from a flexible sheet of material, wherein the outer baffle is wrapped adjacent the outer surface of the coil and the inner baffle is placed adjacent the inner surface of the coil to restrict dirt build-up and corrosive bonding between the coil and the case.

8. The heat exchanger of claim 7 wherein the inner and outer baffles each include an axial slit whereby the baffles can be grasped and removed from the surfaces of the coil after the coil has been removed from the case.

9. A heat exchanger comprising:

a case having a cylindrical inner wall spaced within a cylindrical outer wall forming an annular space therebetween, and an endwall fixed to one end of the case enclosing a first end of the annular space;

a cover detachably fixed to the housing on the end distant from the end wall thereby enclosing a second end of the annular space;

a tube located within the annular space, wherein the tube is formed into a helical coil encircling the inner wall, and wherein the tube includes fluid inlet and outlet connections that extend outside the case and permit circulation of working fluid through the tube;

a means for circulating coolant between adjacent coils of the tube in a spiral path generally corresponding to the space between the convolutions of the helical coil, wherein the circulating means includes a coolant inlet for introducing coolant to the interior of the case and a coolant outlet for removing coolant from the case; and, inner and outer baffles formed from a flexible sheet of material and wrapped adjacent the inner and outer surfaces of the helical coil, respectively, thereby substantially isolating the coil from the inner and outer walls of the case and limiting dirt and corrosive build-up between the coil and the case; and, wherein the radial width of the annular space steadily increases from its smallest value at the first end to its largest value at the second end of the annular space such that when the cover is detached from the case, the coil can be removed from the case with limited impediment.

10. A heat exchanger comprising:

a case having a cylindrical inner wall spaced within a cylindrical outer wall forming an annular space therebetween, and an endwall fixed to one end of the case enclosing a first end of the annular space;

a cover detachably fixed to the housing on the end distant from the end wall thereby enclosing a second end of the annular space;

a tube located within the annular space, wherein the tube is formed into a helical coil encircling the inner wall, and wherein the tube includes fluid inlet and outlet connections that extend outside the case and permit circulation of working fluid through the tube;

a means for circulating coolant between adjacent coils of the tube in a spiral path generally corresponding to the space between the convolutions of the helical coil, wherein the circulating means includes a coolant inlet for introducing coolant to the interior of the case and a coolant outlet for removing coolant from the case;

inner and outer baffles formed from a flexible sheet of material and wrapped adjacent the inner and outer surfaces of the helical coil, respectively, thereby substantially isolating the coil from the inner and outer walls of the case and limiting dirt and corrosive buildup between the coil and the case; and, wherein the tube is arranged within the annular space such that substantially all of the coolant flows in a helical pattern between adjacent coils of the tube.

11. The heat exchanger of claim 10 wherein the flexible sheet of material from which the inner and outer baffles are formed is flat.

12. The heat exchanger of claim 11, wherein the annular space is tapered from its smallest value at the first end to its largest value at the second end of the annular space such that when the cover is detached from the case, the coil can be removed from the case with limited impediment.

* * * * *